United States Patent [19]

Sidlinger et al.

[11] 4,337,942

[45] Jul. 6, 1982

[54] PORTABLE EXERCISING DEVICE USABLE ALONE OR WITH OTHER DEVICES FOR MULTIPLE ROUTINES

[76] Inventors: Bruce C. Sidlinger; Joanne Sidlinger, both of 2810 Country Club Rd., Garland, Tex. 75042; Bruce D. Sidlinger, 7626 Callaghan Rd., Apt. 3006, San Antonio, Tex. 78229

[21] Appl. No.: 136,431

[22] Filed: Apr. 2, 1980

Related U.S. Application Data

[63] Continuation-in-part of Ser. No. 875,102, Feb. 3, 1978, Pat. No. 4,225,131.

[51] Int. Cl.[3] ..... A63B 23/00

[52] U.S. Cl. ..... 272/144; 272/93

[58] Field of Search ..... 272/93, 109–113, 272/61–66, 70, 70.3, 70.4, 134, 144–146, 117

[56] References Cited

U.S. PATENT DOCUMENTS

| | | | |
|---|---|---|---|
| 2,405,024 | 7/1946 | Eynon | 272/117 |
| 2,673,737 | 3/1954 | Daniels | 272/144 X |
| 2,764,412 | 9/1956 | Dunham | 272/144 |
| 3,006,643 | 10/1961 | Ryan | 272/144 |
| 3,679,203 | 7/1972 | Grana | 272/111 |
| 3,709,487 | 1/1973 | Walker | 272/62 X |
| 3,857,561 | 12/1974 | Cecchettini | 272/109 X |
| 3,944,219 | 3/1976 | Lopresti | 272/62 |
| 3,984,101 | 10/1976 | Garza | 272/144 X |
| 4,193,394 | 3/1980 | Everett et al. | 272/117 X |

FOREIGN PATENT DOCUMENTS

| | | | |
|---|---|---|---|
| 904366 | 7/1972 | Canada | 272/93 |
| 2639307 | 3/1978 | Fed. Rep. of Germany | 272/145 |
| 52-17926 | 10/1977 | Japan | 272/146 |

*Primary Examiner*—Richard J. Apley

*Attorney, Agent, or Firm*—Fisher, Christen & Sabol

[57] ABSTRACT

A portable exercising device which can be assembled and disassembled without the use of special tools for shipping and storage is formed substantially entirely from tubular members to provide a stable support for a pair of shoulder pads and hand grips to permit the user to perform shoulder stands, the device also including an upstanding support for an elevated crossbar which serves as a leg rest when shoulder stands are performed and is also designed for attachment to a separate device, such as a treadmill or rebounding bed, in which case the crossbar serves as a hand grip for running in place or jumping. Another crossbar is attached at a lower position to support the legs when doing sit-ups on the separate device.

4 Claims, 5 Drawing Figures

PORTABLE EXERCISING DEVICE USABLE ALONE OR WITH OTHER DEVICES FOR MULTIPLE ROUTINES

CROSS-REFERENCE TO RELATED APPLICATIONS

This application is a continuation-in-part of our copending application Ser. No. 875,102, filed Feb. 3, 1978, now U.S. Pat. No. 4,225,131.

BACKGROUND OF THE INVENTION

This device is useful for those who travel considerably yet who wish to maintain a regular physical fitness regime because it permits the user to perform various exercise routines, either alone, or in combination with another exercise device and can be assembled for use or disassembled for transport because it comprises a number of tubular elements joined together by easily operated connectors such as bolts and wing nuts.

Exercising devices for performing generally similar routines are known but in each case, they lack certain advantages exhibited by the applicants' device. U.S. Pat. No. 4,077,623 discloses a circular trampoline provided with a circular canopy from which are suspended several freely swinging trapeze bars; these do not provide the support necessary for controlled jumping or running-in-place. U.S. Pat. No. 3,134,592 discloses a framework to be clamped to the headboard of a bed for holding the feet when performing sit-ups; it does not assist in performing other routines. U.S. Pat. No. 3,857,561 discloses a framework for performing shoulder stands and knee hangs. In another position sit-ups can be performed but only with the legs bent at the knees and, with the addition of tubular elements it may serve as parallel bars. U.S. Pat. No. 4,046,373 discloses primarily a pair of low parallel bars, with sliding mats for performing leg stretching exercises as well as several other routines. In U.S. Pat. No. 2,858,132, there is shown a trampoline with an elevated springboard at one end; it is also provided with a pivoted bar which permits the user to jump over the springboard from the trampoline bed so as to similar a fall on the adjoining floor, or ground. U.S. Pat. No. 2,590,049 discloses a foldable framework which supports a resilient rebounding bed, or springboard and, U.S. Pat. No. 3,767,009 discloses an arrangement for attaching the coil springs of a trampoline bed to the supporting framework and for providing cushions to prevent the user's feet from accidentally falling through the spaces between the springs.

SUMMARY OF THE INVENTION

This invention relates to exercising devices, and more particularly to a portable device for use with a small rebounding bed and having an auxiliary frame which enables the user to practice a variety of routines including running in place, sit-ups and hand stands, as well as other exercises which are limited only to the imagination of the user.

An object of the invention is to provide a portable exercising device which can be easily dismantled for shipment and quickly assembled for use without the use of special tools.

Another object of the invention is to provide an exercise device which can be attached to a small rebounding bed of known construction, or to some other type of body support device, such as a treadmill or a back-supporting cushion in order to perform a variety of exercises such as controlled jumping, running in place or sit-ups.

Other objects and advantages will be apparent to those skilled in the art after reading the following specification in connection with the annexed drawings, in which:

BRIEF DESCRIPTION OF THE DRAWINGS

FIGS. 1–3 are perspective views of a preferred form of portable exercising device constructed in accordance with the invention in which FIG. 1 illustrates its use for jumping, or simulated running in place; FIG. 2 illustrates its use for practicing sit-ups; FIG. 3 shows the user doing a shoulder and hand stand.

DESCRIPTION OF A PREFERRED EMBODIMENT

Figure 2:
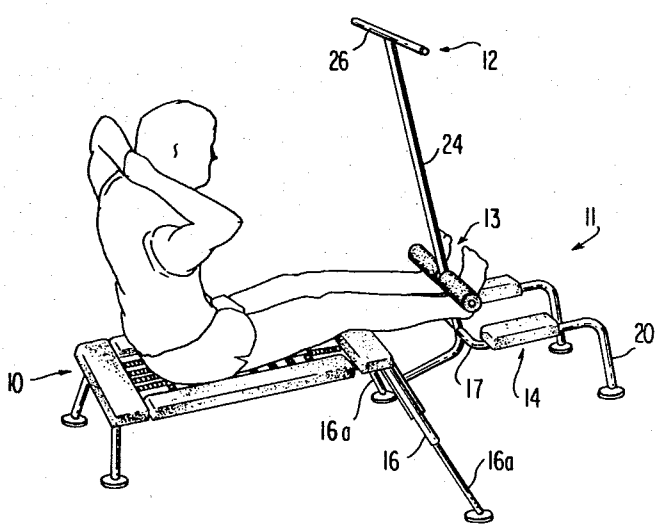

In the drawing the numeral 10 indicates generally, a small rebounding bed of the type disclosed in U.S. Pat. No. 2,590,049, numeral 11 indicates generally a framework for supporting a crossbar, indicated generally at 12, leg supports indicated generally at 13, and shoulder pads indicated generally at 14.

Figure 3:
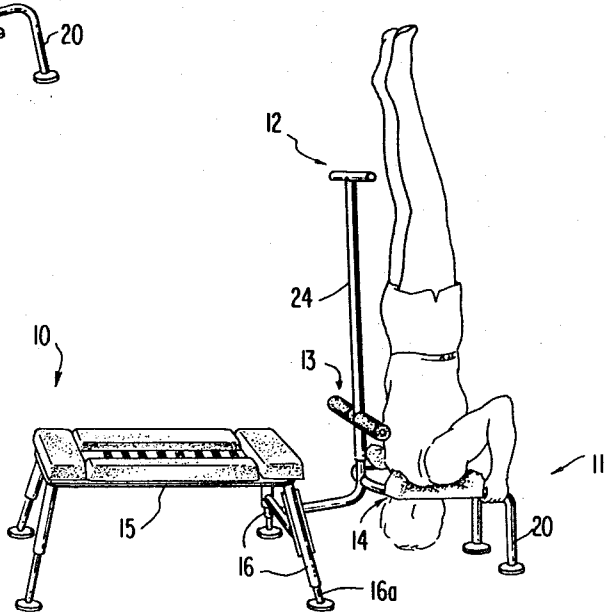
Figure 1:
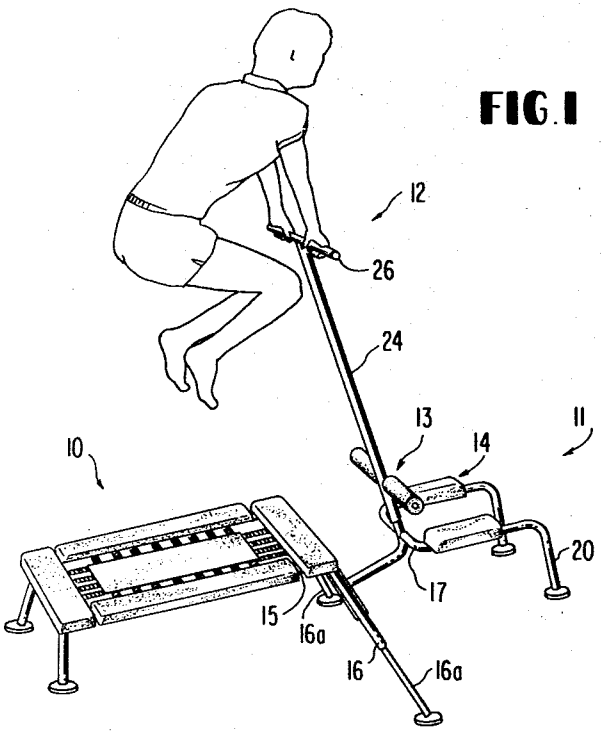
Figure 4:
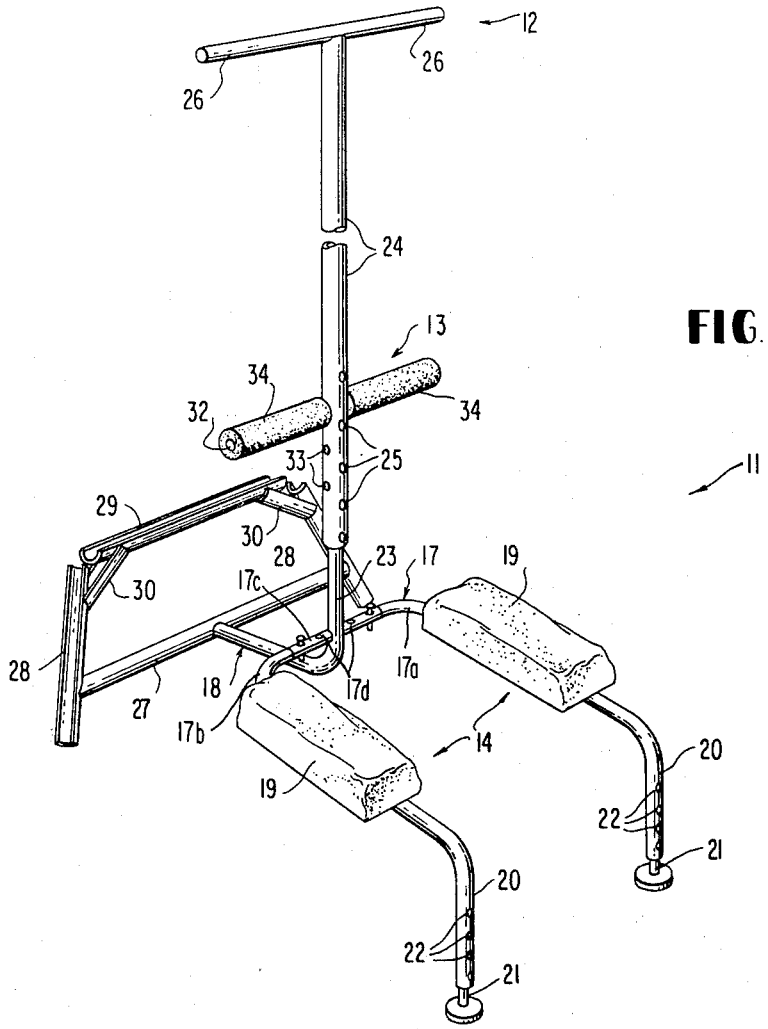
FIG. 4 is a perspective view, on an enlarged scale, of that portion of the device which is detachably connected to a small rebounding bed.
Figure 5:
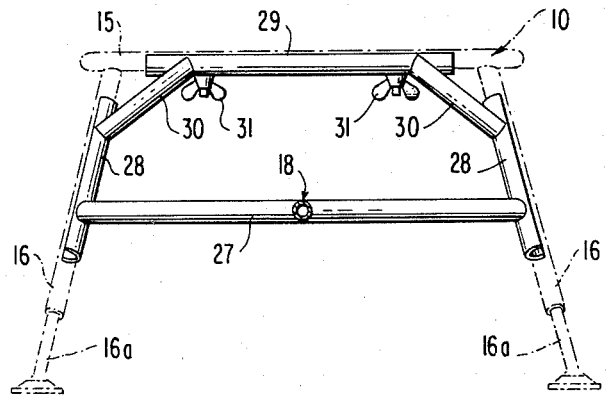
FIG. 5 is a vertical section looking towards the rebounding bed illustrating the manner in which the bed and auxiliary support are detachably joined together.

The rebounding bed 10 is preferably rectangular and includes a horizontal framework 15 made of tubing which is supported by at least two outwardly and downwardly divergent legs 16 which may be provided with telescoping adjustable extension 16*a*, which allows the bed to be tilted as shown in FIGS. 1 and 2 to be disposed in the horizontal position of FIG. 3. The bed itself consists of a flexible sheet secured by the frame 15 by a series of tensioned springs which may be connected to the frame by adjustable connectors to permit varying the spring tension and the springs may be covered on their upper sides by appropriate padding or by the interweaving of an elastic cord.

The auxiliary frame 11 is also preferably formed from tubular material which comprises a first tube system 17 and a second tube system 18. The first tube system is generally U-shaped and formed to provide a pair of horizontal portions which support a pair of shoulder supporting pads 19 and terminate in a pair of downwardly extending legs 20 which may be provided with telescoping extensions 21 which can be adjusted in length by a pin inserted through openings 22. In order to permit the horizontal distance between the shoulder pads 19 to be adjusted the tube system may be subdivided into three sections whereby the respective inwardly directed portions 17*a* and 17*b* provide extensions which are telescopically received within the horizontal straight section 17*c* and are held in place by pins inserted into coacting openings 17*d*.

The second tube 18 is generally L-shaped, and joined to the tube 17 so that one end 23 extends in an upward direction to telescopically engage with a vertically extending tubular section 24, the portion of which may be adjusted by a pin inserted through matching openings 25. The upper end of tube 24 supports a pair of outwardly extending hand grips 26 for use as shown in FIG. 1. The other end of tube 24 extends generally in a horizontal direction away from the first 17 and is joined, as by welding, to the center of a transverse horizontal member 27.

Horizontal member 27 is welded, or otherwise attached, at its respective ends to a pair of elongated half-sleeves 28 which are disposed angularly with respect to each so as to mate with the inner surfaces of legs 16 of the rebounding device. In this connection it should be noted that the lengths of the legs 20 should preferably be short enough so that with the extensions 21 retracted the framework 11 may rest level on the supporting surface when used alone. Another elongated half-sleeve 29 is connected to the upper ends of the half-sleeves 28 by elements 30, or the half-sleeves 28 and 29 could be formed integrally.

The horizontal frame member 15 of the bed 10 may be provided with a pair of downwardly projecting bolts which may extend through matching holes drilled in half-sleeve 29 to receive wing nuts 31 which allow the half-sleeve 29 to be drawn upwardly toward frame member 15 when the device is assembled. In this connection it should be noted that the relationship between the half-sleeves 28 and the half-sleeve 29 is such that when the former are in firm engagement with the diverging legs 16 there will still remain some space between the horizontal members 15 and 29 to ensure the rigidity of the connection between the two assemblies 10 and 11.

The leg support 13 may comprise an elongated rod 32 which passes through one of a series of openings 33 drilled in the vertical extension 24, the protruding ends of the rod being fitted with cylindrical pads 34 to the legs of the user down when executing sit-ups, as shown in FIG. 2. If desired, the vertical tube 23 may extend upwardly a sufficient distance that openings in this tube can also be drilled to match with various ones of the openings 33 whereby the height of the crossbar 12 can be adjusted by removal and insertion of rod 32 instead of a separate pin inserted in openings 25. Either arrangement, however, will allow the adjustment of the crossbar 12 and pads 34 with respect to the plane of the rebounding bed 10 or the shoulder pads 19.

It will be understood that the framework 10, which is shown as supporting a rebounding bed could be adapted to support other forms of body supporting device, such as a treadmill, for running in place, or simply a pad, or cushion, to support the back when doing sit-ups with the aid of the leg rest 13. It will also be realized that the crossbar 12 serves two functions in that when the user is doing a shoulder stand it will act as a back-up to control the position of the feet, when elevated, whereas when the user is in an upright position doing controlled jumping or running in place, the two arms 26 of the crossbar 12 will serve as hand grips.

Other objects and improvements which will be obvious to those skilled in the art would come within the scope of the annexed claims.

We claim:

1. A portable exercise device for performing a variety of exercise routines such as shoulder stands, when used alone, and rebounding, running in place or sit-ups when used in combination with another separate free-standing exercise device having a generally horizontal user supporting surface, comprising frame means having a plurality of downwardly projecting horizontally spaced supports for contact with a horizontal surface and disposed to stabilize the frame means, said frame means including a pair of horizontally spaced shoulder pads and cooperating hand grips for performing a shoulder stand, said frame means including a framework having a supporting structure generally resembling an inverted U to be detachably connectable to a mating structure included in said another exercise device, said frame means further including crossbar means supported at an elevated location disposed medially above the space defined by contact with said downwardly projecting supports, said crossbar means comprising alternatively a leg rest for a shoulder stand and hand grips when performing a routine in an upright position.

2. A portable exercise device as defined in claim 1, wherein the downwardly projecting arms of the respective U-shaped structures are disposed in downwardly divergent relationship to each other, one of said structures being disposed within the other of said structures in tightly interengaging relationship.

3. A portable exercise device as defined in claim 2, wherein one of the respective structures is formed of tubular material and the other of the respective structures is formed of elongated elements which partially encircle said tubular material.

4. A portable exercise device as defined in any one of claims 1, 3 or 4, wherein said means to support crossbar means at an elevated location also includes means to support a second crossbar means at a lower elevation to provide a leg rest for the user when performing sit-ups.

* * * * *